United States Patent [19]

Parker et al.

[11] 4,172,966

[45] Oct. 30, 1979

[54] AM STEREOPHONIC RECEIVER

[75] Inventors: Norman W. Parker, Wheaton; Francis H. Hilbert, Addison, both of Ill.

[73] Assignee: Motorola, Inc., Schaumburg, Ill.

[21] Appl. No.: 880,686

[22] Filed: Feb. 23, 1978

[51] Int. Cl.[2] ..... H04H 5/00

[52] U.S. Cl. ..... 179/1 GS; 329/135

[58] Field of Search ..... 179/1 GS, 15 BT; 325/36; 329/122, 124, 129, 132, 135

[56] References Cited

U.S. PATENT DOCUMENTS

| | | | |
|---|---|---|---|
| 3,068,475 | 12/1962 | Avins | 179/15 BT |
| 3,218,393 | 11/1965 | Kahn | 179/1 GS |
| 3,534,172 | 10/1970 | Weeda | 179/1 GS |
| 3,908,090 | 9/1975 | Kahn | 179/1 GS |
| 4,079,204 | 3/1978 | Takahashi et al. | 179/1 GS |

*Primary Examiner*—Douglas W. Olms

*Attorney, Agent, or Firm*—Margaret Marsh Parker; James W. Gillman

[57] ABSTRACT

An AM receiver for utilizing a broadcast signal of the form $(1+L+R)\cos(\omega_c t+\phi)$ separates the L and R signals by utilizing phase detection and matrixing. Distortion is either eliminated with non-linear amplification or reduced with partial matrixing.

13 Claims, 6 Drawing Figures

AM STEREOPHONIC RECEIVER

BACKGROUND OF THE INVENTION

This invention relates to the field of compatible AM stereophonic receivers and more particularly to the use of phase detection and non-linear amplification for deriving the L and R signals.

A system for transmitting and receiving a compatible AM stereophonic signal of the form $(1+L+R)\cos(\omega_c t+\phi)$ where $\phi$ is arc tan $[L-R)/(1+L+R]$ was disclosed in a patent application Ser. No. 674,703, assigned to the same assignee as is the present invention. In the receiver of that application, and in all others now known, a correction factor proportional to $\cos\phi$ is derived in the receiver. Wherever it is necessary in the particular receiver circuitry, signals including $\cos\phi$ are divided by the correction factor to provide the original sum and difference signals and, eventually, the L and R signals to the stereo outputs. It would be advantageous to utilize tangential correction since less correction is required for a given signal level.

SUMMARY OF THE INVENTION

It is an object, therefore, of the present invention to provide a receiver for a compatible AM stereo signal which does not require a cosine correction factor.

It is another object to provide a simple receiver with minimal distortion or, utilizing tangential correction, a receiver with essentially no distortion.

These objects and others are provided in a receiver in accordance with the invention and wherein the broadcast signal is received and a corresponding IF signal is provided. The amplitude information on this IF signal is detected in an envelope detector. The phase information is detected by a phase detector, amplified in a non-linear (tangential) amplifier, multiplied by the amplitude information, and matrixed to provide the original stereo signals. If desired, the non-linear amplifier can be omitted and partial matrixing used to reduce the ensuing distortion.

BRIEF DESCRIPTION OF THE DRAWINGS

FIG. 3*b* is a circuit diagram of a tangential amplifier which is one element of the receiver of FIG. 3*a*.

DETAILED DESCRIPTION OF THE PREFERRED EMBODIMENT

This invention will best be understood in relation to the various drawing figures in which like numerals have been used throughout to reference identical elements.

The receiver shown is intended for use with a standard stereophonic AM broadcast signal of the form $(1+L+R)\cos(\omega_c t+\phi)$ where $\phi$ is arc tan $[(L-R)/(1+L+R)]$. It is to be noted that the expression $\omega_c t$ as used herein represents a carrier frequency which may be either RF or IF, as the case may be.

Figures 1, 2, 3A:
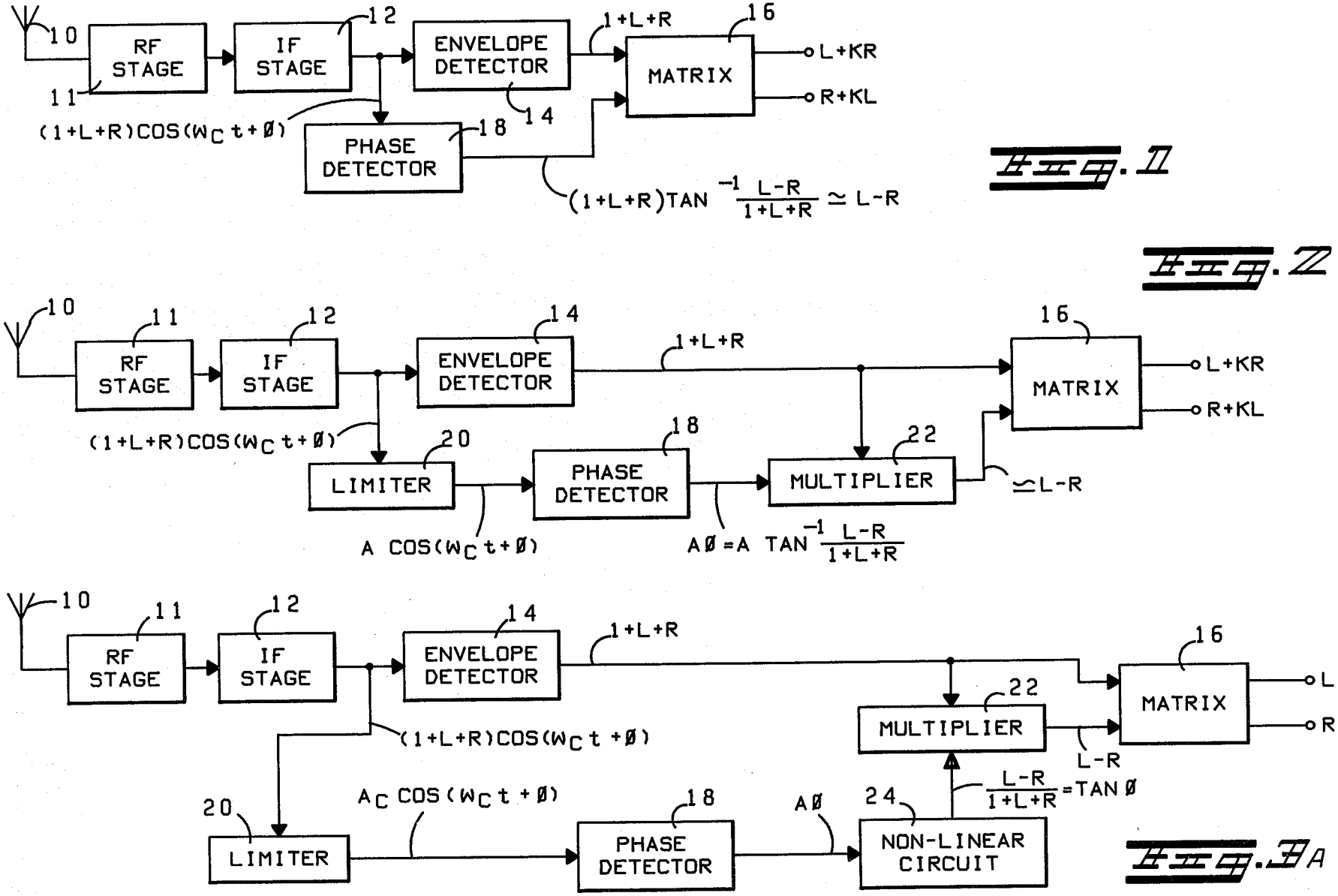
FIG. 1 is a block diagram of a simplified receiver.
FIG. 2 is a block diagram of an improved receiver.
FIG. 3*a* is a block diagram of another embodiment of the receiver.

In FIG. 1 a simplified receiver is shown, having an antenna 10, RF stage 11 and IF stage 12 which may be of the types generally used in AM broadcast band receivers. The output of the IF stage 12, which is $(1+L+R)\cos(\omega_c t+\phi)$, is coupled to an envelope detector 14, the output of which is essentially $1+L+R$. This output signal is coupled to a matrix 16. The output from the IF stage is also coupled to a phase detector 18, the output signal of which is proportional to both phase and amplitude i.e., $k(1+L+R)$ arc tan $[L-R)/(1+L+R)]$. This is approximately $L-R$, since arc tan $\phi$ is $\simeq\phi$ for angles of modulation less than $\pi/4$. This output signal is also coupled to the matrix 16.

Since the receiver of FIG. 1 is a simplified design, and the matrix 16 would have a certain amount of distortion in its output due to the aforementioned approximation, it may be considered desirable to use partial matrixing to reduce this distortion. As an example, if the level of the signal which approximates $L-R$ is reduced by 20%, thus reducing the distortion by a significant amount, it will be seen that the matrix 16 output signals will be $L-0.11\ R$ and $R+0.11\ L$. These signals, of course, provide a very slightly reduced stereo separation, but the tradeoff of a small amount of separation for significantly reduced distortion is often considered a desirable choice. Thus the output signals of the matrix 16 are indicated in FIG. 1 to be $L+kR$ and $R+kL$ where k may be any value from zero to any desired fraction less than one.

The receiver of FIG. 2 is another embodiment of the receiver of FIG. 1. Instead of coupling the IF signal directly to the phase detector 18, the IF signal is first amplitude limited in limiter 20. The limiter output signal is then $A\cos(\omega_c t\ \phi)$ where A may be any constant. The output signal of phase detector 18 will then be $A\ \phi$ or A arc tan $[L-R]/(1+L+R)]$. This signal is coupled to a multiplier 22 as is the $1+L+R$ signal from the envelope detector 14. The output signal of the multiplier 22 is $(1+L+R)$ arc tan $[(L-R)/(1+L+R)]$ which is $L-R$, again assuming that arc tan $\phi$ approximately equals $\phi$. As in the embodiment of FIG. 1, the matrix 16 can provide output signals of L and R with a small amount of distortion, or the $L-R$ signal can be reduced by some fraction e.g. 20%, in which case the matrix output signal would be $R+0.11\ L$ and $L+0.11\ R$ and as before, this reduces the separation slightly, but makes a significant reduction in the distortion. The chief difference between the receivers in FIGS. 1 and 2 is that in FIG. 2, the phase detector 18 operates on a constant amplitude input signal.

The receiver of FIGS. 3*a* and 3*b* is an improved embodiment which does not contain the small amount of distortion discussed hereinabove with respect to FIGS. 1 and 2. The antenna 10, RF stage 11, IF stage 12 and envelope detector 14 function as described above with respect to FIGS. 1 and 2. As before, the output signal $(1+L+R)\cos(\omega_c t+\phi)$ from the IF stage 12 is coupled to a limiter which outputs $A\cos(\omega_c t+\phi)$ where A is a constant. The phase detector 18 receives this signal and outputs $A\ \phi$ to a non-linear (tangential) circuit 24 such as is shown in FIG. 3*b*.

The non-linear circuit 24 as embodied in FIG. 3*b* includes a differential input amplifier 25 having both inputs coupled to the phase detector output. With identical inputs (one is inverted) and without the two diodes 26, there would be no output from the amplifier 25. With the diodes 26 in the circuit 24, and a relatively small input signal, the output is a linear function of the input since the diodes do not affect the output. However, as the input signal increases, one diode clips the input signal on each half wave and the output signal begins to rise at a rate greater than a linear rate, approximating a tangent function of the input signal (see FIG. 4.). Since the non-linear circuit 24 is a tangential amplifier, the output signal of the amplifier is tan $\phi$ which is $(L-R)/(1+L+R)$. This signal is multiplied by $1+L+R$ in the multiplier 22, providing an output signal to the matrix 16 which is $L-R$. Thus, the inputs to the matrix 16 are $1+L+R$ and $L-R$, which can be fully matrixed to provide undistorted L and R output signals.

Figure 4:
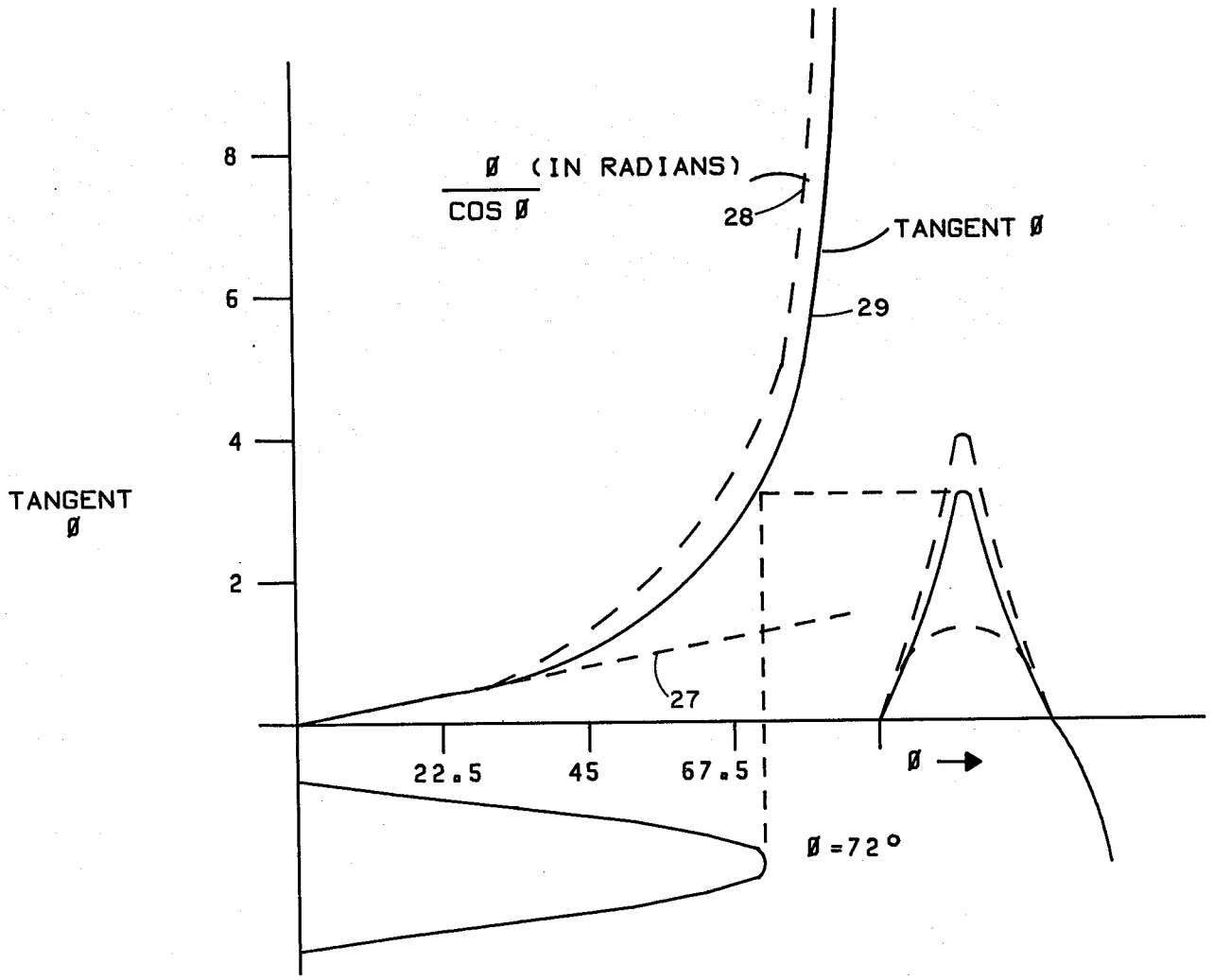
FIG. 4 is a chart of comparative amplifier characteristics.

FIG. 4 is a chart of amplifier transfer characteristics. Curve 27 is a linear characteristic for an amplifier having a gain of unity. Curve 28 is for an amplifier with gain varying in proportion to the input signal so that the output signal is proportional to the input signal divided by its cosine. Curve 29 is for an amplifier with gain varying in proportion to the input signal so that the output signal is proportional to the tangent of the input signal. The characteristic of the circuit 24 is approximately the curve 29, as determined by the values of the various components.

Figure 5:
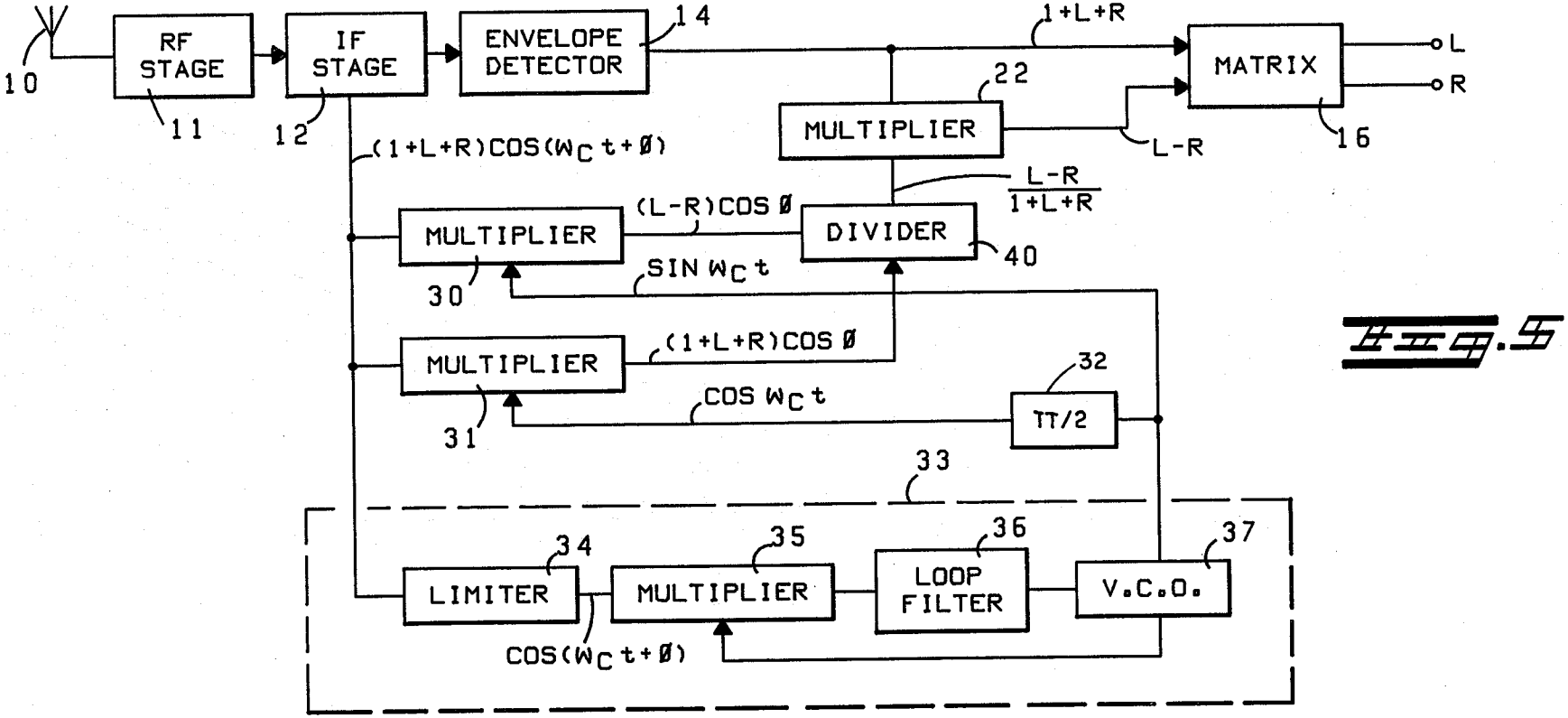
FIG. 5 is still another embodiment of the receiver.
Figure 5B:
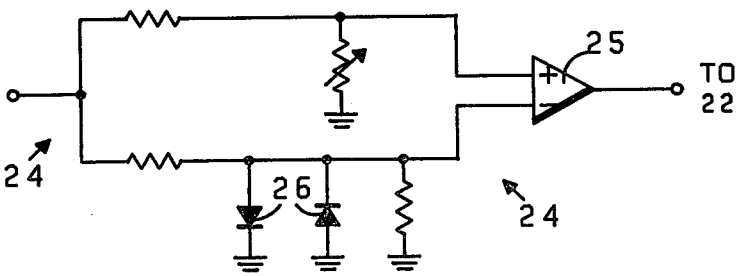

In FIG. 5 the function of the antenna 10 RF stage 11, IF stage 12, envelope detector 14, multiplier 22, and matrix 16 are as described hereinabove. In this embodiment of the invention, the output signal from the IF stage 12, which is $(1+L+R)\cos(\omega_c t+\phi)$ is coupled to multipliers 30 and 31. The IF stage output is also coupled to a circuit, such as the phase locked loop 33, which will provide an unmodulated carrier frequency signal which is locked in phase with the original carrier signal. The phase locked loop 33 contains a limiter 34, multiplier 35, filter 36 and voltage controlled oscillator 37. In the limiter 34, the IF stage output is amplitude limited to provide an output which is the function of $\cos(\omega_c t+\phi)$. The output of the VCO 37 is a sine function of the intermediate frequency carrier and it is coupled directly to a multiplier 30 and is coupled to a multiplier 31 through a 90° phase shifter 32, thus providing a $\cos \omega_c t$ input to the multiplier 31. The output signal of the multiplier 30 is thus a function of $\cos \phi(L-R)$ and the output signal from the multiplier 31 is a function of $\cos \phi(1+L+R)$. In a divider 40, the output signal from the multiplier 30 is divided by the output signal from the multiplier 31, thus providing from the divider 40 an output signal which is a function of $(L-R)/(1+L+R)$. When this signal is coupled to the multiplier 22, wherein it is multiplied by $1+L+R$, the multiplier 22 output signal is $L-R$, and a substantially distortion-free output is provided at the outputs of the matrix 16.

Thus there has been provided, in accordance with the present invention, a receiver for receiving compatible AM stereophonic broadcast signals of the form $(1+L+R)\cos(\omega_c t+\phi)$ but not requiring correction by a cosine factor. The receiver may provide undistorted output signals by the use of a tangential amplifier circuit, by a double-multiplier-divider circuit or, alternatively, output signals having minimal distortion, but requiring no correction factor at all. Other variations and modifications of the above embodiments are possible, and it is intended to cover all such as fall within the spirit and scope of the appended claims.

What is claimed is:

1. An AM stereophonic receiver for receiving a signal of the form $(1+L+R)\cos(\omega_c t+\phi)$ where L and R are intelligence signals, $\omega_c t$ is the carrier frequency and $\phi$ is arc tan $\{(L-R)/(1+L+R)\}$, and comprising in combination:

input means for selectively receiving and amplifying said signal;

first circuit means coupled to the input means for providing a first intermediate signal related to tangent $\phi$;

second circuit means coupled to the input means for providing a second intermediate signal related to the amplitude modulation on the received signal; and matrixing means coupled to the first and second circuit means for providing output signals substantially proportional to L and R.

2. An AM stereophonic receiver in accordance with claim 1 and wherein the input means includes an RF stage and an IF stage.

3. An AM stereophonic receiver in accordance with claim 1 and wherein the signal related to tangent $\phi$ is of the form $(1+L+R)$arc tan $\{(L-R)/(1+L+R)\}$.

4. An AM stereophonic receiver in accordance with claim 3 and wherein the first circuit means includes a phase detector coupled to the IF stage.

5. An AM stereophonic receiver in accordance with claim 3 and wherein the matrixing means provides partial matrixing.

6. An AM stereophonic receiver in accordance with claim 1 and wherein the signal related to tangent $\phi$ is of the form A arc tan $\{(L-R)/(1+L+R)\}$ where A is a constant.

7. An AM stereophonic receiver in accordance with claim 1 and wherein the first circuit means comprises limiter means for removing amplitude variations from the received signal, phase detector means for detecting the phase modulation on the amplitude-limited signal, and multiplier means coupled to receive the output signals of the second circuit means and the phase detector means, the multiplier output signal being coupled to the matrixing means.

8. An AM stereophonic receiver in accordance with claim 6 and wherein the matrixing means provides partial matrixing.

9. An AM stereophonic receiver in accordance with claim 1 wherein the signal related to tangent $\phi$ is proportional to tangent $\phi$.

10. An AM stereophonic receiver in accordance with claim 9 and wherein the first circuit means comprises limiter means for removing amplitude variations from the received signal, phase detector means for detecting phase modulation on the limited signal, amplifying means coupled to receive the output signal from the phase detector means for non-linear amplification of the phase detector output signal, and multiplier means for multiplying the output signals from the amplifier means and the second circuit means.

11. An AM stereophonic receiver in accordance with claim 10 and wherein the non-linear amplifying means comprises a tangential amplifier.

12. An AM stereophonic receiver in accordance with claim 9, the receiver further including, third circuit means for providing a signal having the original unmodulated carrier frequency and locked in phase therewith, phase shifter means for shifting the phase of a portion of the third circuit means output signals by 90°, and wherein the first circuit means includes first and second multiplier means and divider means, the first multiplier means being coupled to receive the output signal from the input means and the phase shifted output signal from the third circuit means, the second multiplier means being coupled to receive the output signal from the input means and the unshifted output signal from the third circuit means, the divider means being coupled to receive the output signals of the first and second multiplier means, and third multiplier means coupled to receive the output signals from the second circuit means and the divider means.

13. An AM stereophonic receiver in accordance with claim 12 and wherein the third circuit means is a phase locked loop.

* * * * *